United States Patent [19]

Kjose

[11] Patent Number: 4,657,135

[45] Date of Patent: Apr. 14, 1987

[54] COMBINED GOLF BAG AND EQUIPMENT CARRIER

[76] Inventor: Kenneth L. Kjose, Apt. 202, 1319 E. Harvard, Glendale, Calif. 91205

[21] Appl. No.: 771,478

[22] Filed: Sep. 3, 1985

Related U.S. Application Data

[63] Continuation of Ser. No. 475,504, Mar. 15, 1983, abandoned.

[51] Int. Cl.[4] ..... A45C 5/12; A45C 5/14; A63B 55/00; A63B 55/06

[52] U.S. Cl. ..... 206/315.3; 206/315.4; 206/315.5; 206/315.7; 150/52 G; 150/52 E; 190/109; 190/18 A; 190/26; 248/96

[58] Field of Search ..... 206/315.2–315.8; 150/52 J, 52 E, 52 F, 52 G; 190/109, 110, 26, 18 A; 248/96; 280/DIG. 6; 273/32 R

[56] References Cited

U.S. PATENT DOCUMENTS

| | | | |
|---|---|---|---|
| 646,869 | 4/1900 | Perkes | 206/315.2 |
| 1,521,260 | 12/1924 | Trachtenberg | 190/110 X |
| 1,521,310 | 12/1924 | Moran . | |
| 1,624,714 | 4/1927 | Bullock | 206/315.2 X |
| 1,700,734 | 2/1933 | Brandt | 206/315.3 |
| 1,968,579 | 7/1934 | Wheary | 190/110 X |
| 2,324,495 | 7/1943 | Deming | 190/26 X |
| 2,339,580 | 1/1944 | Park . | |
| 2,482,372 | 9/1949 | Rossow | 206/315.2 |
| 2,591,217 | 4/1952 | Thompson | 206/315.4 |
| 2,633,173 | 3/1953 | Reed | 150/52 G |
| 2,704,563 | 3/1955 | Henrich | 150/52 G |
| 2,718,251 | 9/1955 | Barbato | 150/52 G |
| 3,316,951 | 5/1967 | Jacobson | 150/52 G |
| 3,521,689 | 7/1970 | Woods, Jr. | 150/52 G X |
| 3,530,919 | 9/1970 | May | 206/315.4 |
| 3,678,611 | 7/1972 | Files | 206/315.11 X |
| 3,941,398 | 3/1976 | Nelson | 206/315.4 X |
| 3,963,102 | 6/1976 | Carp | 190/110 X |
| 4,091,977 | 5/1978 | Luttbeg | 206/315.4 |
| 4,142,563 | 3/1979 | Ackerfeldt et al. | 206/315.5 |
| 4,234,025 | 11/1980 | Berge | 206/315.4 |
| 4,245,684 | 1/1981 | Street et al. | 206/315.4 |
| 4,375,847 | 3/1983 | Picco | 206/315.2 |
| 4,506,769 | 3/1985 | Franco et al. | 190/110 X |

FOREIGN PATENT DOCUMENTS

| | | | |
|---|---|---|---|
| 6126 | of 1911 | United Kingdom | 206/315.3 |
| 1277431 | 6/1972 | United Kingdom | 206/315.3 |

*Primary Examiner*—William Price
*Assistant Examiner*—Sue A. Weaver
*Attorney, Agent, or Firm*—Christie, Parker & Hale

[57] ABSTRACT

A combined golf bag and equipment carrier is disclosed and comprises a generally cylindrical golf bag and an elongated box-like container into which the golf bag can be fitted lengthwise at a level above the bottom of the container to provide storage space in the container. The combined golf bag and equipment carrier further comprises a covering for securing the golf bag in the container and a strap attached to the covering for carrying the golf bag and container. The strap can also be used as a shoulder strap for the golf bag.

26 Claims, 9 Drawing Figures

COMBINED GOLF BAG AND EQUIPMENT CARRIER

CROSS-REFERENCE TO RELATED APPLICATIONS

This is a continuation of application Ser. No. 475,504 filed Mar. 15, 1983, abandoned.

FIELD OF THE INVENTION

This invention relates to golf bags and more particularly to a combined golf bag and equipment carrier for safely transporting or shipping golf clubs and associated golf equipment.

BACKGROUND OF THE INVENTION

Traditionally, golf clubs and associated equipment including shoes, balls, tees and the like are transported or shipped in a conventional golf bag having a flexible cover mounted over the heads of the golf clubs which extend out of the bag. The use of such a golf bag for transporting or shipping golf clubs and associated equipment has several drawbacks. In order to provide adequate storage space for the associated equipment, the golf bag must have several storage compartments or pouches which results in a golf bag which is heavy and cumbersome. Such a golf bag is difficult and tiresome to carry over the entire length of a golf course.

Further, most golf bags have a flexible bag which, along with a flexible cover, does not provide much protection to golf clubs contained within the golf bag from impacts against the golf bag or the jostling that occurs when such golf clubs are transported or shipped from one location to another, e.g., by car, plane or the like. Further, such golf bags typically have flexible exterior pouches which offer little protection to the equipment carried in the pouches during such transport.

In U.S. Pat. No. 4,182,391 to Kjose, there is described a combined golf bag and equipment carrier which comprises a reversible case that can be converted from a travel bag for carrying equipment, such as clubs, clothing and shoes, to a golf bag for use on the course. As an equipment carrier, the case surrounds the golf clubs and accessory equipment. Such an equipment carrier is lightweight, provides plenty of storage space and is easily carried. The case can be reversed to provide access to the golf clubs and thereby be converted into a golf bag which is ideally suited for being carried by a motor-driven golf cart or pull cart. The case is somewhat inconvenient to use as a "carry" bag over a full length golf course because the exposed sides of the bag constitute a plurality of tubes rather than a smooth surface. Also, in order to be reversible, the case must be very flexible. As such, the case does not provide optimal protection for the golf equipment contained within the case when used as an equipment carrier.

SUMMARY OF THE INVENTION

This invention provides a combined golf bag and equipment carrier comprising a generally cylindrical golf bag and an elongated box-like container into which the golf bag can be fitted lengthwise. The golf bag comprises a generally cylindrical bag and a generally cylindrical cover which is releasably attachable to the bag. The golf bag is separable from the container and can be readily used as a "carry" bag in transporting golf clubs about a golf course or the like. The golf bag is preferably constructed out of a rigid or semi-rigid material.

The container comprises means for supporting the golf bag in the container at a select level above the bottom of the container. The container preferably comprises means for supporting the golf bag at a level wherein the longitudinal axis of the golf bag is at about the elevation of the top of the container. The space in the container below the golf bag is used for storage of equipment. The interior of the container is thus dividable into an upper section for fittedly receiving the golf bag in a lengthwise arrangement and a lower section for storing associated equipment. The width of the upper section is preferably about equal to the diameter of the golf bag to prevent the golf bag from rolling around in the container. Likewise, the length of the upper section is about equal to the length of the golf bag to prevent lengthwise movement of the golf bag in the container.

The lower section of the container is preferably subdivided into a plurality of compartments by partitioning walls. In a particularly preferred embodiment of the invention, the partitioning walls extend upwardly to a level wherein the top edges of the partitioning walls provide support for the golf bag when it is fitted in the upper section of the container.

The combined golf bag and equipment carrier further comprises means for releasably securing the golf bag in the upper section of the container to thereby form an assembled unit, i.e., a combined golf bag and container, which prevents movement of the golf bag relative to the container. Preferred means for releasably securing the golf bag in the upper section of the container comprises a covering which can be fitted closely over the container and golf bag when the golf bag is fitted in the upper section of the container.

Another preferred means for releasably securing the golf bag in the upper section of the container comprises a flap which is attached along one side of the container and which can extend over the golf bag to the opposing side of the container and which is releasably attachable to the opposing side of the container.

Carrying means are provided for supporting the assembled unit from the hand or the shoulder of a person. Preferred carrying means comprises a strap which is releasably attachable at its ends to the assembled unit so that the strap acts as a handle which can be grasped by the hand. Alternatively, the strap can be attached to the assembled unit so that the strap can extend over the shoulder of the person to thereby act as a shoulder strap for the assembled unit. The strap is also releasably attachable to the golf bag for providing a shoulder strap for the golf bag when it is carried separately.

Another preferred carrying means comprises a handle which is attached to the golf bag and which, when the golf bag is fitted into and secured in the upper section of the container, extends upwardly and can be grasped by hand for carrying.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
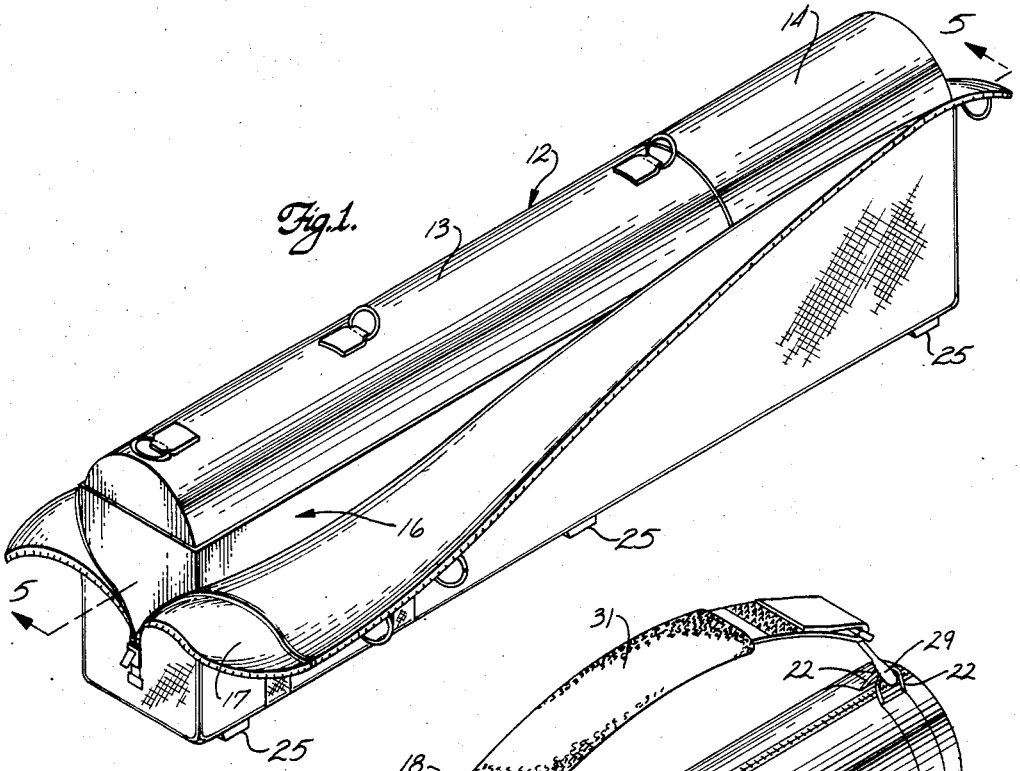
FIG. 1 is a perspective view of a preferred combined golf bag and equipment carrier with the cover open.

With reference to FIG. 1, there is shown a preferred combined golf bag and equipment carrier. The combined golf bag and equipment carrier comprises a golf bag 12 for carrying golf clubs having a generally cylindrical bag 13 with a generally cylindrical cover 14. The golf bag is fitted lengthwise into an elongated box-like container 16 so as to provide a space below the golf bag for the storage of equipment.

The combined golf bag and equipment carrier further comprises a flexible covering 17 (shown open) which is enclosable over the golf bag 12 and container 16 to form an assembled unit. The covering 17 secures the golf bag 12 in the container 16 and inhibits movement of the golf bag relative to the container. The covering 17 is made of a durable, preferably water-proof, cloth-like material and provides some protection to the combined golf bag and container.

A strap 18 is releasably attached to the covering 17 for carrying the assembled unit. The strap 18 can be attached to the covering 17 at positions so that the assembled unit can be carried by hand or the strap 18 can be attached to the covering 17 so that the strap can extend over the shoulder of a person, e.g., a golfer, for supporting the unit from the shoulder.

Figure 2:
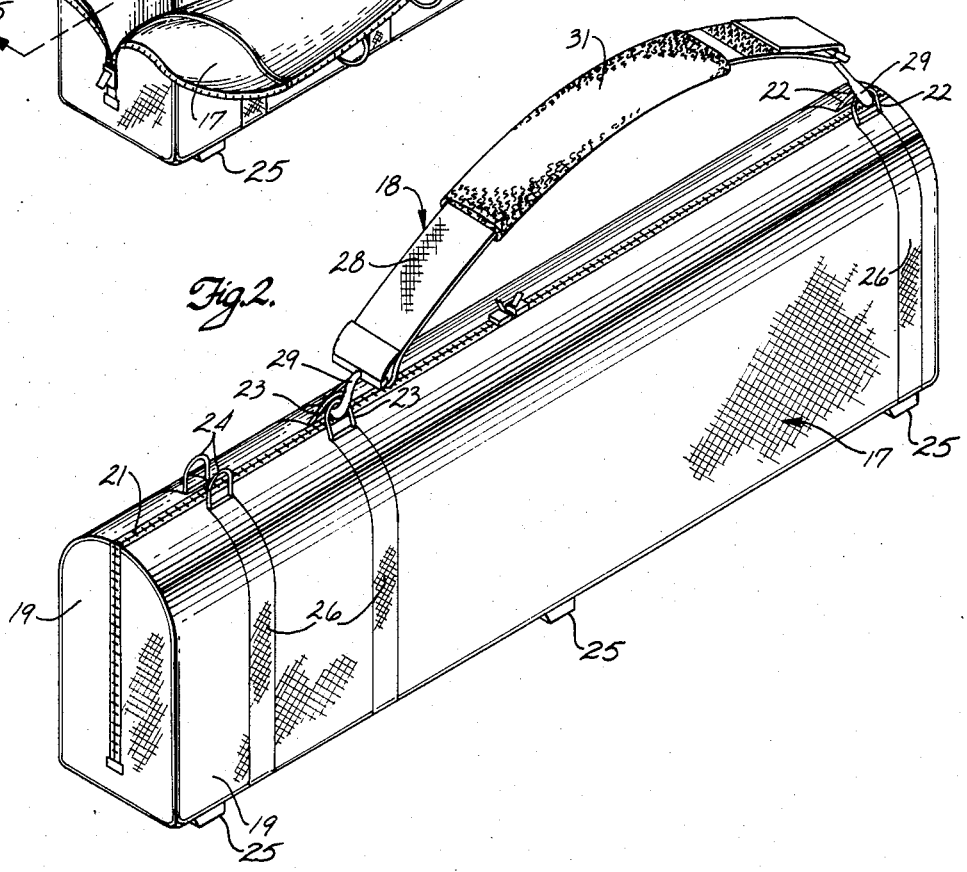
FIG. 2 is a perspective view of the combined golf bag and equipment carrier shown in FIG. 1 with the cover closed.

With reference to FIG. 2, the covering 17 comprises a bottom panel (not shown) covering the bottom of the container 16 and a pair of generally allochiral side panels 19 which extend from the bottom panel upwardly over the sides of the container 16 and over the golf bag 12. The side panels 19 also extend to about the midpoint of each end of the combined container 16 and golf bag 12. The side panels 19 are releasably joined along their edges by means of a zipper 21 and along with the bottom panel completely enclose the container 16 and golf bag 12. When the side panels 19 are joined, the zipper 21 extends upwardly across both ends of the assembled unit and across the top or length of the assembled unit. Other means for joining the side panels, such as buckles, snaps, and plastic fastening tapes, can be used.

The covering 17 further comprises three pairs of D-rings, each pair straddling the zipper 21 when the side panels are joined, i.e., one D-ring of a pair is attached to each side panel 19 adjacent the zipper 21. The D-ring pairs provide means for attaching the strap 18 to the covering 17. such a pair of D-rings straddling the zipper 21 is preferred as it distributes the weight of the assembled unit to both side panels when the assembled unit is carried.

The first pair of D-rings 22 are attached to the covering 17 at the positions which, when the covering is closed over the combined golf bag and container, are above and adjacent one end of the golf bag 12. The second pair of D-rings 23 are positioned a select distance from the first pair so that when the strap 18 is engaged with the first and the second pairs of D-rings as shown in FIG. 2, there is sufficient slack in the strap to enable the strap to extend over the shoulder of a person to be used as a shoulder strap.

The third pair of D-rings 24 are located a sufficient distance from the first pair to provide sufficiently little slack in the strap 18 when it is engaged with the first and third pairs of D-rings to enable the strap to be grasped and used as a conventional handle. In other words, when the strap is engaged with the first and third pairs of D-rings, the assembled golf bag and container will be supported by the strap a short distance below the hand when the strap can be grasped and lifted by the hand.

Rubber or plastic feet 25 are provided extending downwardly from the bottom panel of the covering 17 for protecting the covering 17 from wear when the combined golf bag and equipment carrier rests on the ground or floor. The feet 25 are preferably fastened through the covering 17 to the container 16 and provide means for attaching the covering 17 to the container 16.

A support strap 26 is provided for attaching each of the D-rings to the covering 17. Each support strap 26 is connected to a D-ring by forming an enclosed loop around the straight section of the "D". The support strap 26 is attached along its length to the covering 17, e.g., by stitching or the like. The support straps 26 provide a means for distributing the weight of the assembled unit across a large area of the covering 17 rather than focusing the weight at individual points of attachment as would be the case if the D-rings were attached directly to the covering. The support straps 26 thereby prevent tearing of the covering 17 at such points of attachment.

The strap 18 comprises a belt 28 and a clip 29 at each end of the strap 18 for releasably engaging a pair of the D-rings. Each clip 29 comprises a loop through which an end of the belt 28 extends. At one end of the strap the belt extends through the loop in the clip and is doubled back on the main portion of the belt, i.e., the portion extending between the clips, in a face-to-face engagement, and is secured by stitching or the like. At the other end, the belt extends through the loop of the clip and is doubled back on itself. The doubled-back portion of the belt is releasably secured to the main portion of the belt by conventional means such as by plastic fastening tape such as a nylon tape closure manufactured by Velcro Corp. of New York and marketed under the trade name Velcro, by a buckle or the like which enables the length of the strap 18 to be adjusted.

The strap 18 comprises a sheepskin sleeve 31 surrounding at least a portion of the belt 28 which is movable along the length of the belt. The sheepskin sleeve 31 enhances the comfort of carrying the combined golf bag and equipment carrier, especially if the combined golf bag and equipment carrier is carried with the strap extending over the shoulder of the person.

Figure 3:
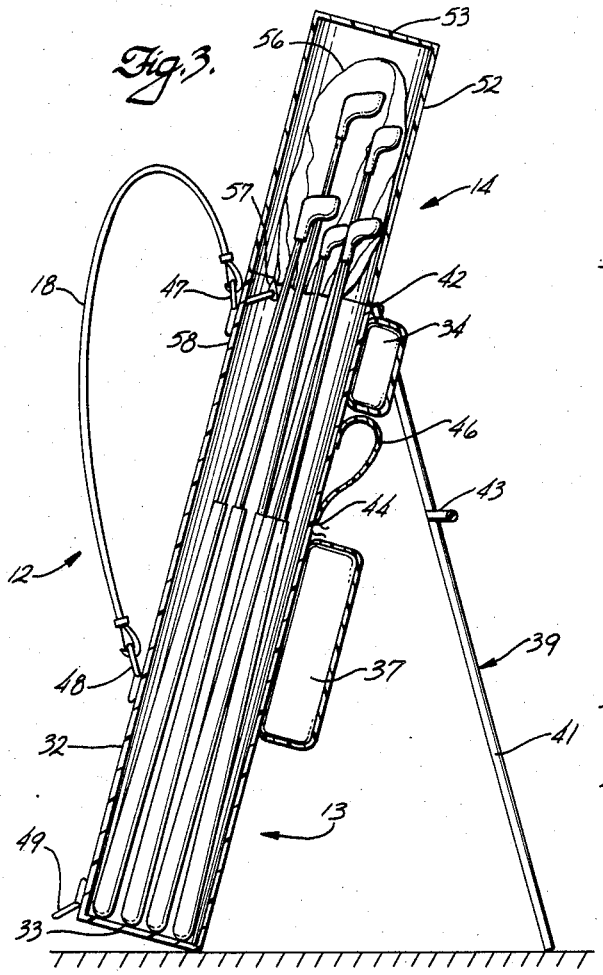
FIG. 3 is a longitudinal cross-sectional view of the golf bag shown in FIG. 1 taken along lines 3—3 of FIG. 1.
Figure 4:
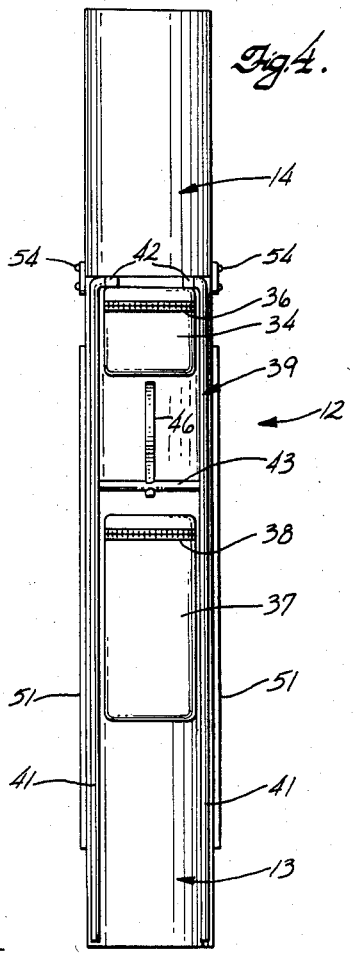
FIG. 4 is a side view of the golf bag shown in FIG. 3.

With reference to FIGS. 3 and 4, there is shown a preferred golf bag 12 for carrying golf clubs at a golf course or the like and which can be fitted into the container when the golf clubs are transported or shipped, e.g., by car, airplane or the like. The golf bag 12 comprises a bag 13 for carrying the golf clubs and a cover 14 for protecting the portions of the golf clubs which extend out of the bag.

The bag 13 is of generally cylindrical construction having a generally cylindrical side wall 32, a flat bottom wall 33 and an open top. The side wall 32 and bottom wall 33 are preferably constructed from a durable, lightweight material. Presently preferred materials include rigid or semi-rigid materials such as plastics and the like as such materials tend to provide a greater amount of protection to the golf clubs carried within the golf bag when the golf bag is transported or shipped than a flexible cloth-like material. Such a rigid or semi-rigid material may be covered with a cloth or cloth-like material for protection and to enhance the comfort of carrying the bag. Cloth-like materials along with leather and leather-like materials can be used if desired.

The length and width of the bag 13 are not critical. Golf bags having an overall length of about 46 inches and a bag length of about 35 inches with diameters of about 6 and 7 inches are presently preferred so that the golf bag according to the present invention is very similar to conventional barrel bags.

The bag 13 comprises a pair of external zippered pouches, a smaller upper pouch 34 near the open top and a larger lower pouch 37 near the enclosed bottom. The smaller pouch 34 is enclosable by means of a zipper 36 and provides space for the storage of small articles such as keys, wallets, rings and the like. The larger pouch 37 is also enclosable by means of a zipper 38 and can be used to store extra golf balls, tees, towels and the like. In the exemplary embodiment shown, the external pouches are openable and closable by means of zippers; however, other closure members such as buckles, clips, plastic fastening tapes and the like can also be used.

The bag 13 further comprises a generally rigid stand 39 for maintaining the golf bag in a generally upright position when the bag 13 is not being carried. The stand 39 comprises two legs 41 which extend along the length of the bag 13 on either side of the external pouches from a top end between the upper pouch 34 and the open end of the bag 13 to a bottom end below the lower pouch 37. At the top of each leg, there is provided a hinge 42 which connects the legs 41 to the bag 13 so that the legs can be pivoted from a collapsed position with the legs adjacent the side wall 32 of the bag 13 outwardly from the bag to an extended position. In the extended position, the bag 13 can be maintained upright with the weight of the bag resting on the legs 41 of the stand 39 and the corner of the bag 13 at the junction of the bottom wall 33 and the side wall 32 of the bag.

A rigid crossbar 43 extends between the two legs 41 at a level just above the lower pouch 37 for stabilizing the legs 41. The crossbar 43 is curved in an arc generally concentric with the bag so that in the collapsed position, both legs and the crossbar are positioned against the exterior of the bag. A clip 44 is provided on the bag 13 for releasably engaging the crossbar 43 for maintaining the stand in a collapsed position against the bag 13 when the bag is carried.

The bag 13 further comprises a handle 46 positioned between the upper pouch 34 and the lower pouch 37 and above the crossbar 43 of the stand. The handle 46 provides means for supporting the bag 13 from a hand.

On the side of the bag 13 opposite the external pouches, the golf bag comprises three D-rings. The first D-ring 47 is mounted on the exterior of the bag 13 at a position adjacent the top of the bag. The second D-ring 48 is attached to the exterior of the bag 13 at a position corresponding to about the level of the lower pouch 37. The first and second D-rings 47 and 48 provide anchors for the attachment of strap 18 to the bag 13 and are spaced apart a distance which provides sufficient slack in the strap 18 to enable the strap 18 to extend over the shoulder of the person carrying the bag 13 for supporting the bag by the shoulder.

A third D-ring 49 is attached to the side wall 32 of the bag 13 at a position near the bottom wall 33. The third D-ring 49 provides a handle for facilitating the removal of the bag from the container.

The bag 13 further comprises a pair of sheepskin covering or sheath 51 extending along at least a portion of the length of each side of the bag 13 between the external pouches and the D-rings to which the strap 18 is attachable. The sheepskin sheath enhances the comfort of carrying the bag for a period, as would be the case if the bag is carried over an entire golf course.

The golf bag 12 further comprises a cover 14 having a generally cylindrical side wall 52 which has a diameter about equal to the side wall 32 of the bag 13 and a generally flat top wall 53. The length of the cover 14 is sufficient so that the cover 14 may be fitted over the portions of golf clubs contained in the bag 13 which extend out of the bag 13. A presently preferred cover 14 has a length of about 11 inches.

The cover 14 is releasably attached to the bag 13 by means of a pair of small straps 54 which are fixedly attached to the side wall 52 of the cover 14 and extend downwardly below the bottom edge of the side wall 52 of the cover 14 to a position adjacent the side wall 32 of the bag 13. The bottom ends of the straps 54 are releasably secured to the bag 13 by means of snaps, plastic fastening tape, buckles or the like.

The cover 14 is preferably made of the same durable, lightweight material as the bag 13 for providing protection to the portions of the golf clubs disposed within the cover 14.

The golf bag 12 further comprises a flexible sack 56 having an opening which is closable by a drawstring 57. The sack 56 is sufficiently large to be fitted over the heads of golf clubs contained in the golf bag 12. The drawstring 57 can be drawn tightly around the shafts of the golf clubs below the heads. The sack 56 thereby prevents unwanted movement and rattling of the clubs relative to each other within the golf bag during transport of the golf clubs.

The bag 13 comprises a fourth D-ring 58 which is attached to the interior surface of the side wall 32 at a position a few inches below the top of the bag 13. This fourth D-ring 58 provides an anchor to which the drawstring 57 of the sack 56 can be tied for securing the golf clubs against the side wall of the bag to further inhibit movement of the golf clubs within the golf bag during their transport.

Figure 5:
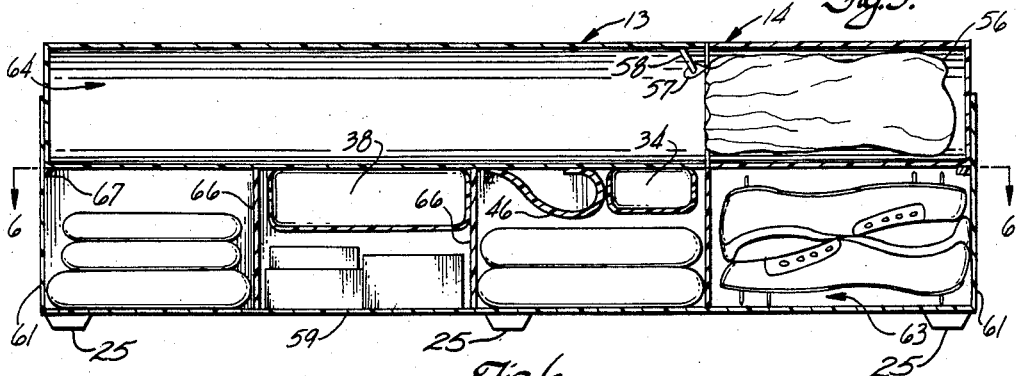
FIG. 5 is a longitudinal cross-sectional view of the container and golf bag shown in FIG. 1 taken along lines 5—5 of FIG. 1.
Figure 6:
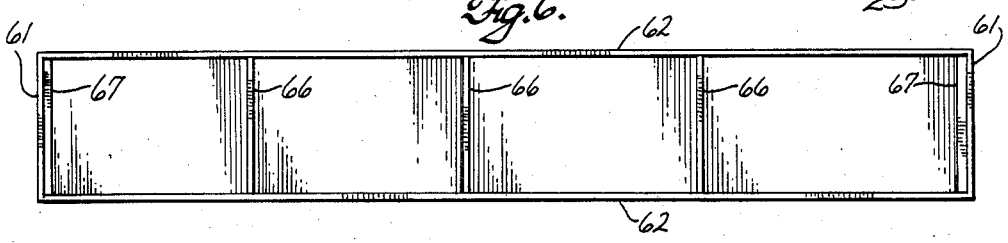
FIG. 6 is a top view of the container shown in FIG. 5.

With reference to FIGS. 5 and 6, the container 16 is preferably made of a lightweight generally rigid material such as a plastic or the like and comprises a bottom wall 59, two end walls 61 and two side walls 62. The side walls 62 are spaced apart a distance about equal to the diameter of the golf bag 12. The end walls 61 are spaced apart a distance about equal to the length of the golf bag 12. In this arrangement, the container prevents the golf bag from rolling around in the container.

The interior of the container 16 comprises an upper section 64 for receiving the golf bag 12, a lower section 63 for storage of equipment and into which the external pouches and handle of the golf bag extend when the golf bag is fitted into the container.

The lower section 63 is divided into four compartments by three partitioning walls 66. Each partitioning wall 66 extends across the container 16 generally parallel to the end walls 61. The partitioning walls 66 extend upwardly from the bottom wall 59 to a position wherein the top edge of the partitioning walls 66 are spaced apart from the top edge of the side walls 62 a distance equal about the radius of the golf bag 12. This allows the golf bag to be fitted into the upper section of the container and to be supported by the top edges of the partitioning walls at a level wherein the longitudinal axis of the golf bag is at about the elevation of the top edges of the side and end walls of the container.

The partitioning walls 66 are spaced apart to form four compartments into which the upper and lower pouches 34 and 37 and the handle 46 of the bag 13 extend when the golf bag 12 is fitted into the container 16. In other words, the partitioning walls 66 are positioned so that the top edges will contact and support the side walls 32 and 52 of the bag 13 and cover 14 of the golf bag 12 rather than contacting the external pouches or handle of the golf bag. The compartments formed between the partitioning walls are sufficiently deep to contain equipment associated with the golf clubs. For example, a pair of shoes may be carried in one compartment, clothing such as a sweater or jacket in another compartment, extra golf balls, tees and the like in a third compartment and rain gear in the fourth compartment.

The container 16 further comprises a generally horizontal rib 67 extending inwardly from each end wall 61 at a level about the same as the level of the top edge of the partitioning walls 66. The ribs 67 provide support for the ends of the golf bag 12 when the golf bag is fitted into the upper section 64 of the container 16.

The preceding description has been presented with reference to a presently preferred embodiment of the invention. It is apparent that changes or alterations in the above described apparatus can be made without departing from the scope of the invention. For example, the use of clips and D-rings is presently preferred for attaching the strap to the covering. However, other methods, such as buckles and the like can also be used.

Figure 7:
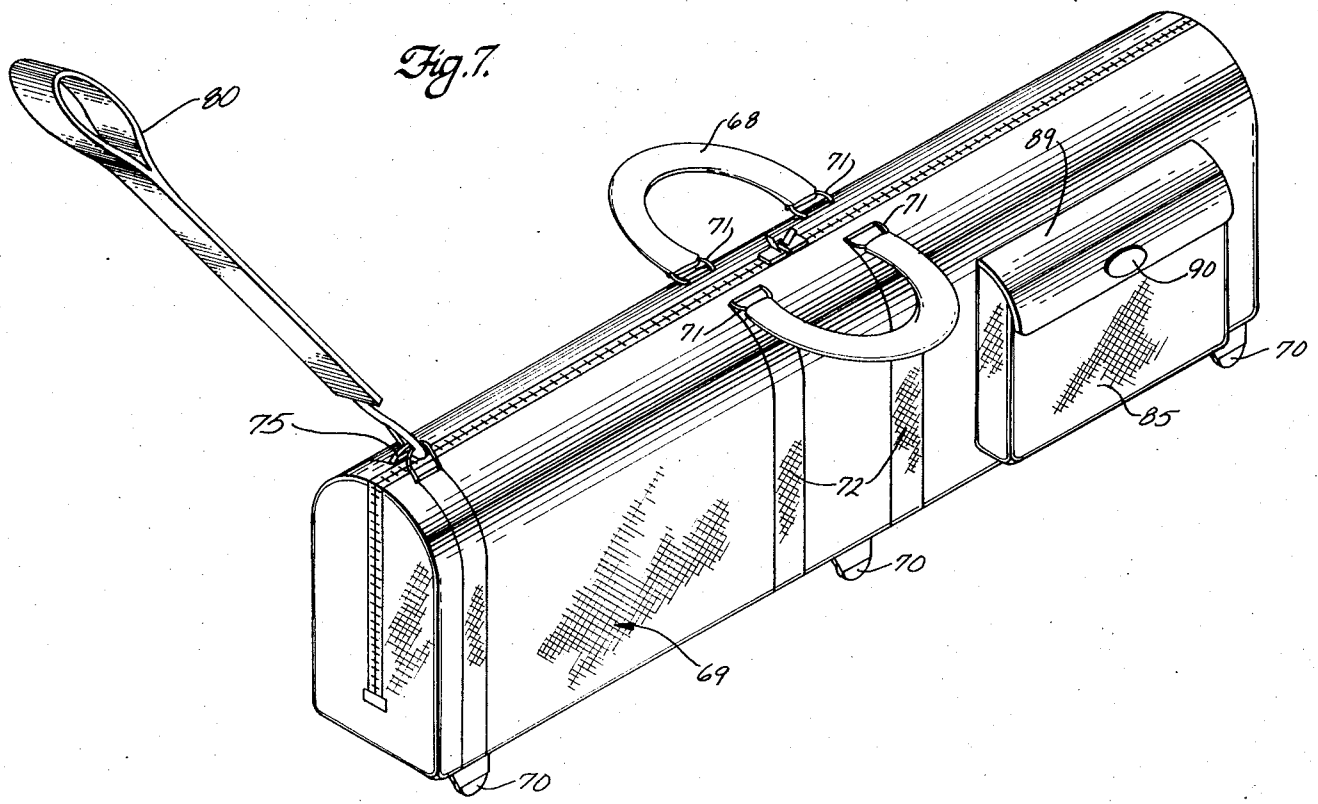
FIG. 7 is a perspective view of a combined golf bag and equipment carrier showing a cover and handle arrangement.

While it is presently preferred to provide a strap which is attachable to the covering for carrying the combined golf bag and container, other carrying means are equally applicable. As shown in FIG. 7, a conventional handle 68 attached to the covering 69, e.g., by D-rings 71 and supporting straps 72, can be used. In such an embodiment, a shoulder strap for carrying the golf bag can be carried in the lower section of the container or in a storage pouch of the golf bag.

Further, luggage rollers 70 may be attached to the bottom of the covering 69 instead of feet. Such rollers 70 allow the combined golf bag and equipment carrier to be rolled rather than carried. In addition, D-rings 75 may be provided to which strap 80 is attachable for use as a towing strap so that one is not required to stoop to roll the combined golf bag and equipment carrier. The covering 69 may also have one or more external compartments 85 for storage of additional equipment, particularly equipment which is not damaged as a result of collisions between the combined golf bag and equipment carrier and other objects. Such a compartment may have a closure member such as flap 89 and snap 90.

Figure 8:
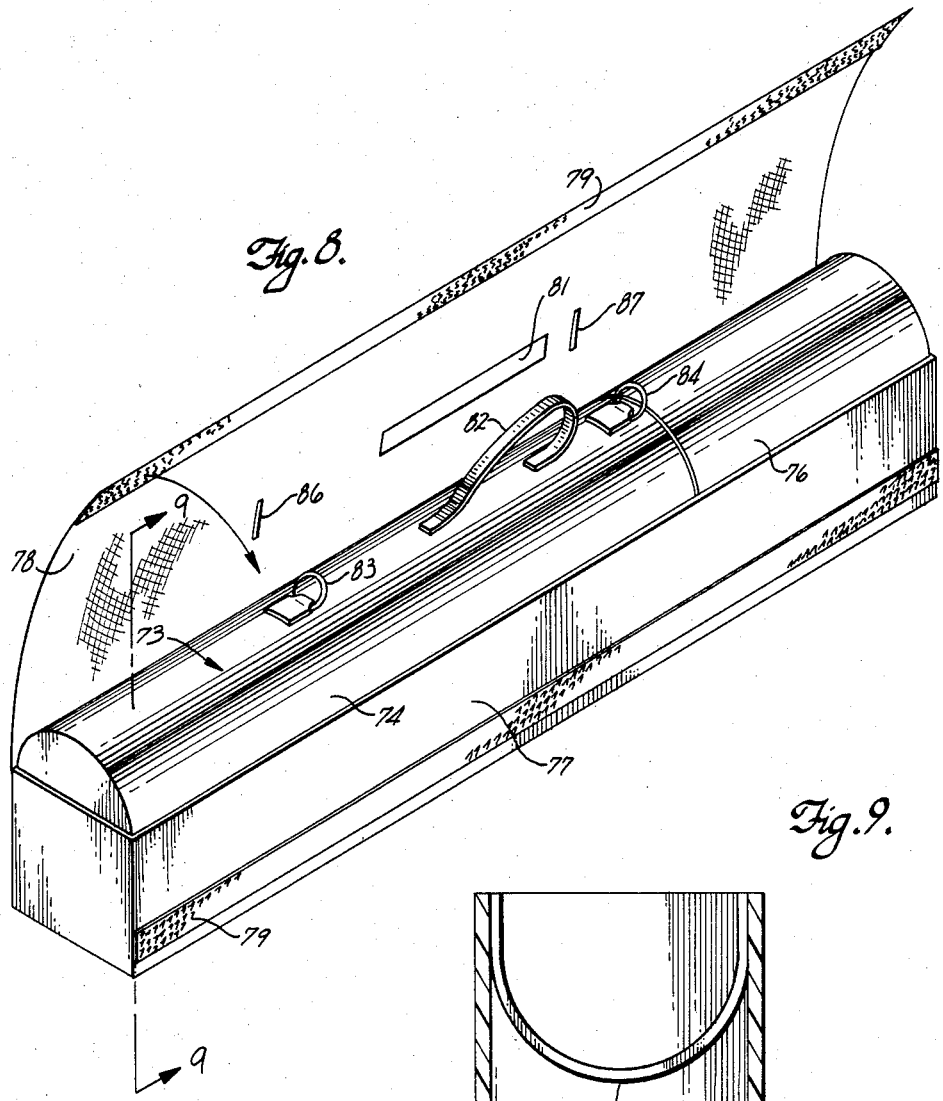
FIG. 8 is a perspective view of another combined golf bag and equipment carrier.

The means for securing the golf bag in the container need not be a covering which completely encloses the golf bag and container. With reference to FIG. 8, there is provided another embodiment of the invention comprising a generally cylindrical golf bag 73 having a bag 74 and a cover 76, an elongated box-like container 77 into which the golf bag 73 can be fitted, and a flap 78 for securing the golf bag 73 in the container 77. The flap 78 is fixedly attached to one side of the container 77 and extends over the golf bag 73 to the opposing side of the container 77. The flap 78 is releasably attachable to the opposing side of the container 77. As shown, the flap 78 is attachable to the opposing side of the container by means of a plastic fastening tape 79 but attachment by any conventional means, such as buckles, snaps, zippers and the like can be used. When attached, the flap 78 fits closely over the golf bag 73 and prevents movement of the golf bag 73 relative to the container 77.

The flap 73 has an opening 81, which when the flap extends over the golf bag 73, is above and at about the middle of the golf bag. The golf bag 73 comprises a handle 82 which extends upwardly from the bag 74 when the golf bag 73 is fitted in the container 77. The handle 82 extends through the opening 81 in the flap 78 when the flap 78 extends over the golf bag 73 and provides means for carrying the combined golf bag and container.

The golf bag comprises D-rings 83 and 84 which are attached to the bag 74 and which provide means for attaching a strap, e.g., as shown in FIGS. 1 and 3, to the golf bag 73 for supporting the golf bag from the shoulder when it is carried independently. The flap 78 comprises openings 86 and 87 which correspond in position to the D-rings 83 and 84 when the flap 78 extends over the golf bag 73 so that the rings 83 and 84 extend upwardly through the flap 78. The strap can be attached to the rings which extend through the flap for providing a shoulder strap for carrying the combined golf bag and container.

Figure 9:
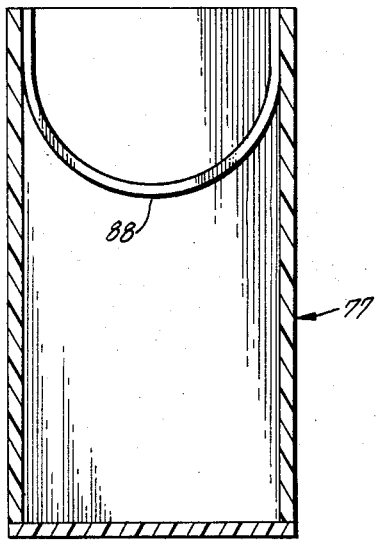
FIG. 9 is a transverse cross-sectional view of the container shown in FIG. 8 taken along lines 9—9 of FIG. 8.

The golf bag can be supported in the container by the top edges of the partitioning walls or by horizontal ribs extending inwardly from the end walls of the container as previously described. Alternatively, as shown in FIG. 9, the golf bag can be supported by one or more slings 88 extending between the side walls of the container 77. The slings 88 are preferably positioned to support each end of the bag and cover of the golf bag when it is fitted into the container 77.

It is apparent that other changes and alterations in the described apparatus as well as combinations of the various described components which were not specifically described can be practiced without departing from the principal spirit and scope of this invention. Accordingly, the foregoing description should not be read as pertaining only to the precise structures and apparatus described, but rather should be read consistent with and as support for the following claims which are to have their fullest fair scope.

What is claimed is:

1. A combined golf bag and equipment carrier comprising:

a golf bag including a generally rigid or semi-rigid cylindrical bag with an open top and closed bottom, and a generally rigid or semi-rigid cylindrical cover releasably attachable to the bag having a diameter about the same as the diameter of the bag and having an open bottom;

an elongated rigid box-like container having side walls, end walls, a bottom wall and an open top, said container having a width about the same as the diameter of the golf bag and a length about the same as the golf bag to thereby receive the golf bag lengthwise and comprising means for supporting the golf bag in the container at a level wherein the golf bag protrudes above the open top of the container and wherein the golf bag is spaced apart sufficiently above the bottom of the container to provide a compartment in the container for the storage of equipment below the golf bag;

flexible cover means extending over the golf bag for releasably securing the golf bag in the container; and carrying means for supporting the golf bag and container from the hand or shoulder of the person when the golf bag is secured in the container.

2. A combined golf bag and equipment carrier as claimed in claim 1 wherein the means for supporting the golf bag in the container supports the golf bag at a level wherein the longitudinal axis of the golf bag is at about the same elevation as the top of the container.

3. A combined golf bag and equipment carrier as claimed in claim 1 wherein the flexible cover means comprises a removable covering which fits closely around the container and the golf bag when the golf bag is in the container.

4. A combined golf bag and equipment carrier as claimed in claim 1 wherein the carrying means comprises a strap releasably connectable to the golf bag or container when the golf bag is secured in the container.

5. A combined golf bag and equipment carrier as claimed in claim 4 wherein the strap is releasably connectable to the golf bag for forming a shoulder strap for the golf bag.

6. A combined golf bag and equipment carrier comprising:

a generally rigid or semi-rigid cylindrical golf bag;

an elongated box-like container having an open top and a width about the same as the diameter of the golf bag and comprising a lower section for storage of equipment, an upper section for fittedly receiving the golf bag along its length and means for supporting the golf bag lengthwise in the upper section so that the golf bag protrudes upwardly out of the open top of the container;

flexible cover means for releasably securing the golf bag in the upper section of the container to thereby form an assembled golf bag and container; and carrying means for supporting the assembled golf bag and container by the hand or by the shoulder of the person.

7. A combined golf bag and equipment carrier as claimed in claim 6 wherein the lower section comprises at least one partitioning wall for subdividing the lower section of the container.

8. A combined golf bag and equipment carrier as claimed in claim 7 wherein means for supporting the golf bag in the upper section comprises the top edge of the partitioning wall.

9. A combined golf bag and equipment carrier as claimed in claim 6 wherein the golf bag is supported in the upper section of the container at a level wherein the longitudinal axis of the golf bag is at about the same elevation as the top of the container.

10. A combined golf bag and equipment carrier as claimed in claim 6 wherein the flexible cover means for releasably securing the golf bag in the upper section of the container comprises an openable flexible covering enclosed around the golf bag and container.

11. A combined golf bag and equipment carrier as claimed in claim 10 wherein the covering comprises a flexible flap fixedly attached to one side of the container which extends over the golf bag to the opposing side of the container and which is releasably attachable to the opposing side of the container.

12. A combined golf bag and equipment carrier as claimed in claim 10 wherein the carrying means comprises a strap releasably attachable at its ends to the covering.

13. A combined golf bag and equipment carrier as claimed in claim 12 wherein the strap is releasably attachable to the golf bag for forming a shoulder strap for the golf bag.

14. A combined golf bag and equipment carrier as claimed in claim 10 wherein the covering comprises an opening above the golf bag when the golf bag is secured in the upper section of the container and wherein the carrying means comprises a handle attached to the golf bag which extends upwardly through the opening in the covering.

15. A combined golf bag and equipment carrier comprising:

a golf bag comprising:

a bag having a generally rigid or semi-rigid cylindrical side wall, a generally flat bottom wall and an open top; and a generally rigid or semi-rigid cover releasably attachable to the bag comprising a generally cylindrical side wall having a diameter about the same as the diameter of the side wall of the bag, a generally flat top wall and an open bottom;

a generally rigid elongated box-like container having an open top into which at least a portion of the golf bag can be fitted lengthwise and comprising:

a bottom wall;

two generally parallel side walls spaced apart a distance about equal to the diameter of the golf bag;

two generally parallel end walls spaced apart a distance about equal to the length of the golf bag; and means for supporting the golf bag in the container at a level above the bottom of the container to provide a storage compartment and wherein the longitudinal axis of the golf bag is at about the same elevation as the top edges of the side walls and end walls of the container;

a flexible covering enclosable around the golf bag and container when the golf bag is fitted in the container for preventing movement of the golf bag relative to the container comprising:

a bottom panel;

a pair of side panels having upper and lower edges attached along their lower edges to the bottom panel; and means for releasably joining the side panels along their upper edges to thereby enclose the covering around the golf bag and container to form an assembled golf bag and container; and a strap releasably attached at its ends to the covering for carrying the assembled golf bag and container.

16. A combined golf bag and equipment carrier as claimed in claim 15 wherein the golf bag further comprises at least one pouch on the exterior of the side wall of the bag which extends downwardly from the side wall of the bag when the golf bag is fitted in the container.

17. A combined golf bag and equipment carrier as claimed in claim 15 wherein the golf bag further comprises a handle attached to the side wall of the bag which extends downwardly from the side wall of the bag when the golf bag is fitted in the container.

18. A combined golf bag and equipment carrier as claimed in claim 15 wherein the golf bag comprises a stand having a pair of legs comprising hinge means at their top ends and being hingedly attached by said hinge means to the side wall of the bag, said legs being afforded pivoting movement between a collapsed position wherein the legs are against the side wall of the bag and an extended position wherein the legs extend towards the bottom wall of the bag and outwardly from the side wall of the bag.

19. A combined golf bag and equipment carrier as claimed in claim 15 wherein the golf bag further comprises a flexible sack having an opening so that the sack can be fitted over the heads of golf clubs disposed in the bag, said sack comprising a drawstring about its opening for cinching the opening around the shafts of tne golf clubs to thereby inhibit movement of the golf clubs relative to each other.

20. A combined golf bag and equipment carrier as claimed in claim 19 wherein the golf bag comprises means for attaching the drawstring of the sack to the inner surface of the golf bag to inhibit movement of golf clubs within the golf bag.

21. A combined golf bag and equipment carrier as claimed in claim 15 wherein the container comprises partitioning walls for subdividing the space below the golf bag, wnen the golf bag is fitted into the container, into two or more compartments.

22. A combined golf bag and equipment carrier as claimed in claim 21 wherein the means for supporting the golf bag in the container comprises the top edges of the partitioning walls, 23. A combined golf bag and equipment carrier as claimed in claim 15 wherein the means for supporting the golf bag in the container comprises a rib extending inwardly from each end wall.

24. A combined golf bag and equipment carrier as claimed in claim 15 wherein the means for supporting the golf bag in the container comprises at least one sling extending between the side walls.

25. A combined golf bag and equipment carrier as claimed in claim 15 further comprising rollers extending below the bottom wall of the container.

26. A combined golf bag and equipment carrier as claimed in claim 17 wherein the covering comprises at least one external compartment for the storage of equipment.

* * * * *

UNITED STATES PATENT AND TRADEMARK OFFICE

CERTIFICATE OF CORRECTION

PATENT NO. : 4,657,135

DATED : April 14, 1987

INVENTOR(S) : Kenneth L. Kjose

It is certified that error appears in the above-identified patent and that said Letters Patent is hereby corrected as shown below:

In the Claims

| | |
|---|---|
| Column 8, Lines 60, 62 | Change "semi-rigid" to -- semirigid -- (both occurrences) |
| Column 9, Line 36 | Change "semi-rigid" to -- semirigid -- |
| Column 10, Line 25 | Change "semi-rigid" to -- semirigid -- |
| Column 10, Line 28 | Change "semi-rigid" to -- semirigid -- |
| Column 11, Line 22 | Change "tne" to -- the -- |
| Column 12, Line 6 | Change "wnen" to -- when -- |

Column 12, line 11, At the end of the sentence, change the "," to --.--
Column 12, line 24, Change "17" to - 15

Signed and Sealed this

Third Day of May, 1988

*Attest:*

DONALD J. QUIGG

*Attesting Officer*

*Commissioner of Patents and Trademarks*